US011151912B2

(12) United States Patent
Qiu

(10) Patent No.: US 11,151,912 B2
(45) Date of Patent: Oct. 19, 2021

(54) CONTROL METHOD, CONTROLLER, AND LIQUID CRYSTAL PANEL DRIVE DEVICE

(71) Applicants: HKC CORPORATION LIMITED, Guangdong (CN); CHONGQING HKC OPTOELECTRONICS TECHNOLOGY CO., LTD., Chongqing (CN)

(72) Inventor: Bin Qiu, Chongqing (CN)

(73) Assignees: HKC CORPORATION LIMITED, Guangdong (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 474 days.

(21) Appl. No.: 16/307,829

(22) PCT Filed: Oct. 22, 2018

(86) PCT No.: PCT/CN2018/111170
§ 371 (c)(1),
(2) Date: Dec. 6, 2018

(87) PCT Pub. No.: WO2020/037808
PCT Pub. Date: Feb. 27, 2020

(65) Prior Publication Data

US 2021/0225219 A1 Jul. 22, 2021

(30) Foreign Application Priority Data

Aug. 24, 2018 (CN) ..... 201810974499.4

(51) Int. Cl.
*G09G 3/00* (2006.01)
*G09G 3/36* (2006.01)

(52) U.S. Cl.
CPC ..... *G09G 3/006* (2013.01); *G09G 3/3611* (2013.01); *G09G 2310/0286* (2013.01); *G09G 2310/0289* (2013.01); *G09G 2310/08* (2013.01)

(58) Field of Classification Search
CPC ..... G09G 2310/0286; G09G 3/006; G09G 2310/08; G09G 2310/0289; G09G 3/3611
See application file for complete search history.

(56) References Cited

U.S. PATENT DOCUMENTS 9,613,594 B2 4/2017 Fang et al.
10,115,361 B2 10/2018 Zhang et al.
(Continued)

FOREIGN PATENT DOCUMENTS

CN 102074216 A 5/2011
CN 103871342 A 6/2014
(Continued)

OTHER PUBLICATIONS

International Search Report for Application No. PCT/CN2018/111170 dated May 16, 2019, 2 pages.
(Continued)

*Primary Examiner* — Muhammad N Edun
(74) *Attorney, Agent, or Firm* — Seyfarth Shaw LLP

(57) ABSTRACT

A control method includes: obtaining a first drive signal output by a level-shift circuit to a first shift register; obtaining a second drive signal output by the level-shift circuit to a second shift register; and controlling a working state of the level-shift circuit according to the obtain drive signals.

20 Claims, 7 Drawing Sheets

(56) References Cited

U.S. PATENT DOCUMENTS

| | | | | |
|---|---|---|---|---|
| 2004/0125065 | A1* | 7/2004 | Park | G09G 3/20 345/92 |
| 2015/0187336 | A1 | 7/2015 | Fang et al. | |
| 2015/0332632 | A1* | 11/2015 | Nakata | G06K 9/0051 345/690 |
| 2016/0078804 | A1* | 3/2016 | Cho | G09G 3/20 345/213 |
| 2016/0171933 | A1* | 6/2016 | Takahara | G09G 3/3258 345/212 |
| 2017/0116943 | A1 | 4/2017 | Zhang et al. | |
| 2017/0256222 | A1* | 9/2017 | Kuo | G09G 3/3677 |
| 2017/0261800 | A1 | 9/2017 | Zhang et al. | |

FOREIGN PATENT DOCUMENTS

| | | | |
|---|---|---|---|
| CN | 103927962 | A | 7/2014 |
| CN | 104658467 | A | 5/2015 |
| CN | 105096876 | A | 11/2015 |
| CN | 105185346 | A | 12/2015 |
| CN | 105223713 | A | 1/2016 |
| CN | 106448594 | A | 2/2017 |
| CN | 106448595 | A | 2/2017 |
| CN | 107703688 | A | 2/2018 |
| KR | 20130070300 | A | 6/2013 |
| KR | 1861609 | B1 | 5/2018 |

OTHER PUBLICATIONS

Chinese Office Action for Application No. 201810974499.4 dated May 14, 2019, 8 pages.

Chinese Office Action for Application No. 201810974499.4 dated Jan. 16, 2020, 8 pages.

Chinese Office Action for Application No. 201810974499.4 dated Jul. 24, 2020, 8 pages.

* cited by examiner

CONTROL METHOD, CONTROLLER, AND LIQUID CRYSTAL PANEL DRIVE DEVICE

This is a National Stage application of, and claims priority to, PCT/CN2018/111170, filed Oct. 22, 2018, which claims priority to Chinese Patent Application No. 201810974499.4, filed Aug. 24, 2018, the disclosures of which are incorporated herein by reference in their entirety.

TECHNICAL FIELD

This application relates to a control method, a controller, and a liquid crystal panel drive device.

BACKGROUND

With the increasing demand for television narrow bezels, a new type of gate driver less (GDL) drive architecture is becoming more and more popular. For a conventional liquid crystal panel, a gate drive IC needs to be bound to the panel. Therefore, a size of the gate IC limits further narrowing of a bezel. However, in recent years, with the advent of the new type of GDL technology, the original Gate IC is divided into two parts: a level-shift chip and a shift register. The level-shift chip is arranged on a drive board. The shift register is arranged on the panel. The level-shift chip delivers a clock signal to the shift register to complete the drive, thereby reducing a length of the bezel. In a commonly used GDL process, shift registers are arranged on both the left and right sides of the panel, making a bilateral drive, but the inventor realizes that reliability of liquid crystal display is poor due to process stability and abnormal display caused by damage on a shift register on one side during use.

SUMMARY

According to various embodiments disclosed in this application, a control method, a controller, and a liquid crystal panel drive device are provided.

A control method includes:

obtaining a first drive signal output by a level-shift circuit to a first shift register;

obtaining a second drive signal output by the level-shift circuit to a second shift register; and when it is detected that the first drive signal is abnormal, controlling the level-shift circuit of the liquid crystal display to stop outputting the first drive signal, or when it is detected that the second drive signal is abnormal, controlling the level-shift circuit to stop outputting the second drive signal, and switching from a bilateral drive mode to a unilateral drive mode.

A controller includes one or more processors, and a memory storing a computer-readable instruction, which, when performed by the one or more processors, cause the one or more processors to execute a program, and the following steps are implemented:

obtaining a first drive signal output by a level-shift circuit to a first shift register;

obtaining a second drive signal output by the level-shift circuit to a second shift register; and when it is detected that the first drive signal is abnormal, controlling the level-shift circuit of a liquid crystal display to stop outputting the first drive signal, or when it is detected that the second drive signal is abnormal, controlling the level-shift circuit to stop outputting the second drive signal, and switching from a bilateral drive mode to a unilateral drive mode.

A liquid crystal panel drive device includes a first shift register, a second shift register, a level-shift circuit, and the foregoing controller.

Details of one or more embodiments of this application are provided in the following accompanying drawings and descriptions. Other features and advantages of this application become more obvious with reference to the specification, the accompanying drawings, and the claims.

BRIEF DESCRIPTION OF THE DRAWINGS

To illustrate the technical solutions according to the embodiments of the present invention more clearly, the accompanying drawings for describing the embodiments are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

To make the technical solutions and advantages of this application clearer and more comprehensible, the following further describes this application in detail with reference to the accompanying drawings and embodiments. It should be understood that the specific embodiments described herein are merely used for explaining this application but are not intended to limit this application.

Figure 1:
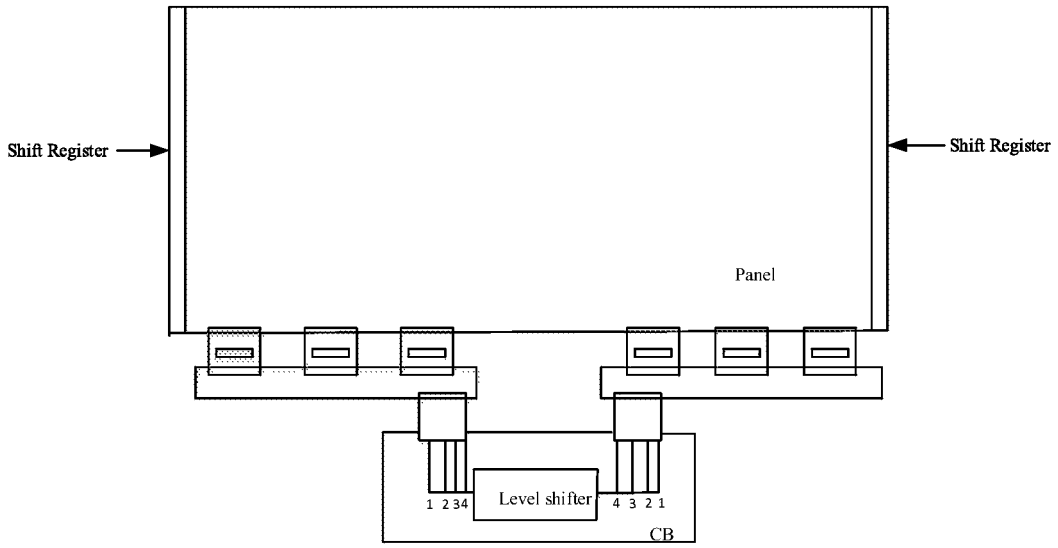
FIG. 1 is an application environment of a control method according to one or more embodiments.

A control method provided in this application is applicable to an application environment shown in FIG. 1. With the increasing demand for narrow bezels of liquid crystal displays, a new type of drive architecture is becoming more and more popular. In the new type of drive architecture, specifically, an original gate drive chip is divided into two parts: a level-shift circuit and a shift register. Then the level-shift circuit is arranged on a drive board. Shift registers are arranged on two sides of a liquid crystal panel. Then the level-shift circuit converts an input low-voltage logic signal into a high-voltage clock signal, and outputs the high-voltage clock signal to the shift registers. The shift registers output scanning signals to the two sides of the liquid crystal panel according to the received high-voltage clock signal, that is, charges each row of the liquid crystal panel from the two sides, to implement bilateral drive of display of the liquid crystal panel. However, reliability of the liquid crystal display is poor due to process stability and abnormal display caused by damage on the shift register on one side during use.

Figure 2:
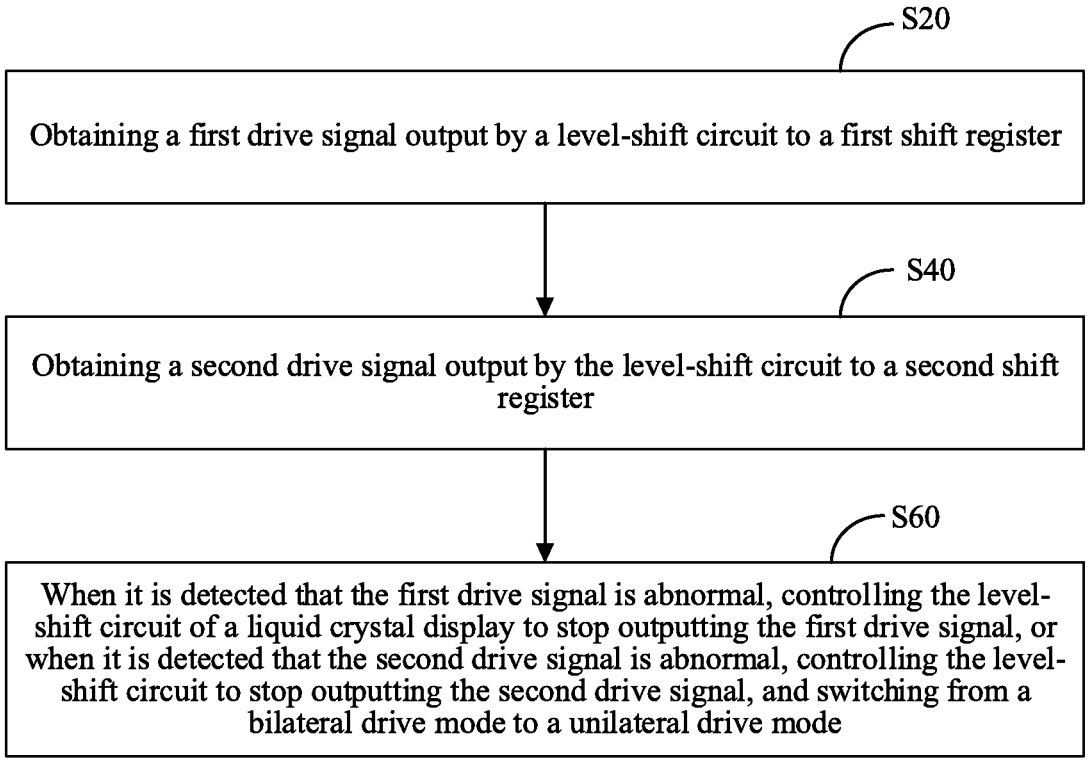
FIG. 2 is a flowchart of a control method according to one or more embodiments.

In some embodiments, as shown in FIG. 2, a control method is provided, which includes the following steps.

In S20, a first drive signal output by a level-shift circuit to a first shift register is obtained.

In S40, a second drive signal output by the level-shift circuit to a second shift register is obtained.

In S60, when it is detected that the first drive signal is abnormal, the level-shift circuit of a liquid crystal display is controlled to stop outputting the first drive signal, or when it is detected that the second drive signal is abnormal, the level-shift circuit is controlled to stop outputting the second drive signal, and a bilateral drive mode is switched to a unilateral drive mode.

As shown in FIG. 1, the level-shift circuit is arranged on a drive board of the liquid crystal display, and the first shift register and the second shift register are respectively arranged on a first side and a second side of the liquid crystal display. The first side can be a left side or a right side of the liquid crystal panel when a picture of the liquid crystal display is normally viewed. The second side is a symmetrical side of the first side. The first shift register is used to drive the liquid crystal panel to display from the first side according to the received first drive signal. The second shift register is configured to drive the liquid crystal panel to display from the second side according to the received second drive signal. The bilateral drive mode refers to that the level-shift circuit outputs the first drive signal and the second drive signal from the two sides respectively, and performs display drive from the two sides of the liquid crystal panel. The unilateral drive mode refers to that the level-shift circuit outputs the first drive signal or the second drive signal from a single side, and performs display drive from one side of the liquid crystal panel.

When the first shift register is damaged, a transmission path from the level-shift circuit to the first shift register is faulty, the first drive signal is abnormal, and display of the liquid crystal panel is abnormal. Similarly, when the second shift register is damaged, a transmission path from the level-shift circuit to the second shift register is faulty, and the second drive signal is abnormal. Therefore, it can be determined, by detecting whether the first drive signal and the second drive signal are abnormal, whether the shift registers are faulty. First, the first drive signal output by the level-shift circuit to the first shift register and the second drive signal output by the level-shift circuit to the second shift register are obtained, and then it is detected whether the first drive signal and the second drive signal are abnormal. When it is detected that the first drive signal is abnormal, it indicates that the first shift register is damaged. To ensure normal working of the liquid crystal panel, the level-shift circuit is controlled to stop outputting the first drive signal to the first shift register, and instead, the second shift register drives the liquid crystal panel on a single side. Similarly, when it is detected that the second drive signal is abnormal, the level-shift circuit is controlled to stop outputting the second drive signal, and the bilateral drive mode is switched to a mode in which the first shift register drives the liquid crystal panel on a single side to display. With this control method, when the shift register on one side is faulty, the output of the level-shift circuit can be controlled to implement switching from the bilateral drive mode to the unilateral drive mode, thereby ensuring normal display of the liquid crystal panel when the shift register on a single side is faulty, and improving reliability of the liquid crystal display.

Figure 3:
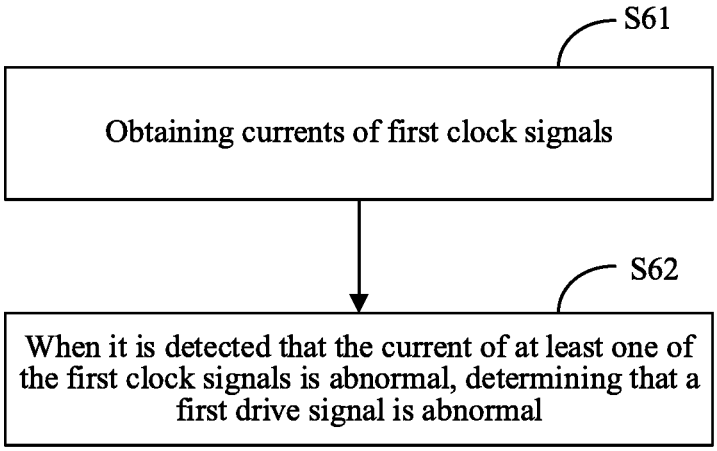
FIG. 3 is a flowchart of steps of detecting whether a first drive signal is abnormal according to one or more embodiments.

In one embodiment, as shown in FIG. 3, the first drive signal includes a plurality of first clock signals, and the step that whether the first drive signal is abnormal is detected includes following steps.

In S61, currents of the first clock signals are obtained.

In S62, when it is detected that the current of at least one of the first clock signals is abnormal, it is determined that the first drive signal is abnormal.

The first clock signal refers to a clock signal output by the level-shift circuit to the first register. The level-shift circuit outputs a plurality of first clock signals to the first shift register. Values of currents of the first clock signals are different in two cases, that is, when the liquid crystal display works normally and when the shift register is damaged. Therefore, when the currents of the first clock signals are obtained, it can be detected, by comparing actual values of the currents of the first clock signals with values of the currents of the first clock signals when the liquid crystal display works normally, whether the currents of the first clock signals are abnormal. If it is detected that currents of one or more first clock signals are abnormal, it is determined that the first drive signal is abnormal. In this case, it indicates that the first shift register may be damaged, and the level-shift circuit needs to be controlled to stop outputting the first drive signal to the first shift register.

Figure 4:
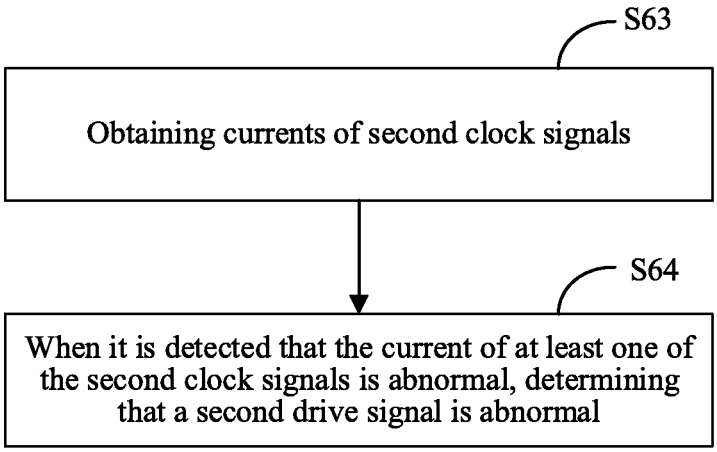
FIG. 4 is a flowchart of steps of detecting whether a second drive signal is abnormal according to one or more embodiments.

In some other embodiments, as shown in FIG. 4, the second drive signal includes a plurality of second clock signals, and the step that whether the second drive signal is abnormal is detected includes following steps.

In S63, currents of the second clock signals are obtained.

In S64, when it is detected that the current of at least one of the second clock signals is abnormal, it is determined that the second drive signal is abnormal.

The second clock signal refers to a clock signal output by the level-shift circuit to the second register. The level-shift circuit outputs a plurality of second clock signals to the second shift register. Values of currents of the second clock signals are different in two cases, that is, when the liquid crystal display works normally and when the shift register is damaged. Therefore, when the currents of the second clock signals are obtained, it can be detected, by comparing actual values of the currents of the second clock signals with values of the currents of the second clock signals when the liquid crystal display works normally, whether the currents of the second clock signals are abnormal. If it is detected that currents of one or more second clock signals are abnormal, it is determined that the second drive signal is abnormal. In this case, it indicates that the second shift register may be damaged, and the level-shift circuit needs to be controlled to stop outputting the second drive signal to the second shift register.

Figure 5:
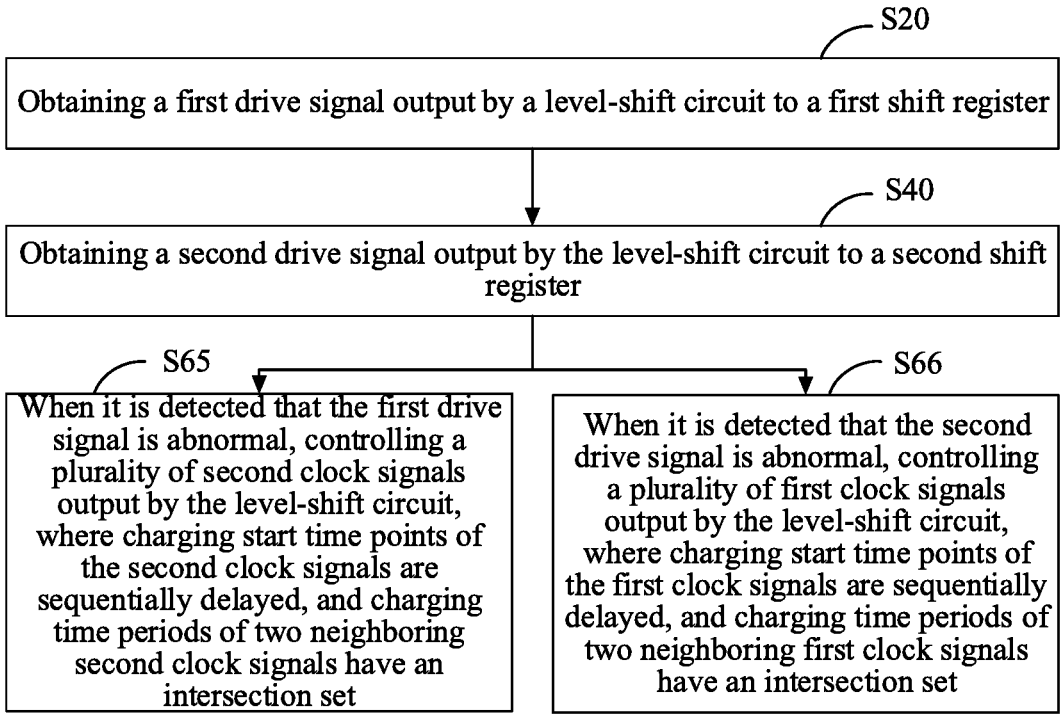
FIG. 5 is a flowchart of a control method according to one or more embodiments.

In one of the embodiments, as shown in FIG. 5, in some embodiment, the second drive signal includes a plurality of second clock signals, and after the step that a bilateral drive mode is switched to a unilateral drive mode, the following step is further included.

In S65, when it is detected that the first drive signal is abnormal, a plurality of second clock signals output by the level-shift circuit are controlled, where charging start time points of the second clock signals are sequentially delayed, and charging time periods of two neighboring second clock signals have an intersection set.

Figure 6:
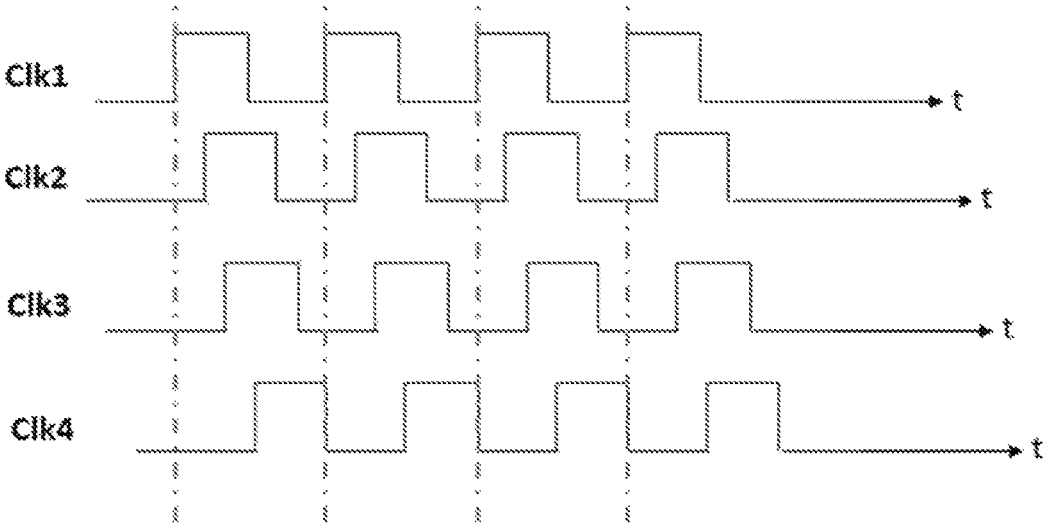
FIG. 6 is a sequence diagram of a clock signal according to one or more embodiments.

A charging start time point of each second clock signal refers to a moment corresponding to a rising edge of a first high level of the clock signal or a falling edge corresponding to a first low level of the clock signal, that is, a time point at which the second clock signal starts to charge a first transistor on a near end of a corresponding row of the liquid crystal panel. That charging time periods of two neighboring clock signals have an intersection set refers to that in a process in which a column of transistors in a previous row are charged according to a previous clock signal, that is, when charging is not completed, precharging of the column of transistors in a next row according to a next clock signal neighboring to the previous clock signal starts. For a large-size liquid crystal panel, unilateral drive causes an insufficient charging time at a remote end, resulting in a phenomenon of nonuniform lightness at the near end and the remote end. Therefore, after the bilateral drive mode is switched to the unilateral drive mode, if the first drive signal is abnormal, charging time periods of the plurality of second clock signals output by the level-shift circuit are controlled to overlap with each other. In a process of charging transistors in a current row of the liquid crystal panel, transistors in a next row are precharged, to ensure sufficient charging time of the next row, so that the liquid crystal panel can be uniformly displayed. As shown in FIG. 6, when the first drive signal is abnormal, the level-shift circuit can output four second clock signals. A first output signal is clk1, a second output signal is clk2, a third output signal is clk3, and a fourth output signal is clk4. Charging start time points of the first, second, third, and fourth second clock signals are sequentially delayed, and charging time periods of two neighboring second clock signals have an intersection set. For example, during charging of a first row according to clk1, precharging of a second row according to clk2 starts, to compensate for a case of nonuniform display at the near end and the remote end caused by a process in a one-end drive mode.

In one of the embodiments, as shown in FIG. 5, the first drive signal includes a plurality of first clock signals, and after the step that a bilateral drive mode is switched to a unilateral drive mode, the following step is further included.

In S66, when it is detected that the second drive signal is abnormal, a plurality of first clock signals output by the level-shift circuit are controlled, where charging start time points of the first clock signals are sequentially delayed, and charging time periods of two neighboring first clock signals have an intersection set.

A charging start time point of each first clock signal refers to a moment corresponding to a rising edge of a first high level of the clock signal or a falling edge corresponding to a first low level of the clock signal, that is, a time point at which the first clock signal starts to charge a first transistor on a near end of a corresponding row of the liquid crystal panel. That charging time periods of two neighboring clock signals have an intersection set refers to that in a process in which a column of transistors in a previous row are charged according to a previous clock signal, that is, when charging is not completed, precharging of the column of transistors of a next row according to a next clock signal neighboring to the previous clock signal starts. For a large-size liquid crystal panel, unilateral drive causes an insufficient charging time at a remote end, resulting in a phenomenon of nonuniform lightness at the near end and the remote end. Therefore, after the bilateral drive mode is switched to the unilateral drive mode, if the second drive signal is abnormal, charging time periods of the plurality of first clock signals output by the level-shift circuit are controlled to overlap with each other. In a process of charging transistors in a current row of the liquid crystal panel, transistors in a next row are precharged, to ensure sufficient charging time of the next row, so that the liquid crystal panel can be uniformly displayed. As shown in FIG. 6, when the second drive signal is abnormal, the level-shift circuit can output four first clock signals. A first output signal is clk1, a second output signal is clk2, a third output signal is clk3, and a fourth output signal is clk4. Charging start time points of the first, second, third, and fourth first clock signals are sequentially delayed, and charging time periods of two neighboring first clock signals have an intersection set. For example, during charging of a first row according to clk1, precharging of a second row according to clk starts, to compensate for a case of nonuniform display at the near end and the remote end caused by a process in a one-end drive mode.

Figure 7:
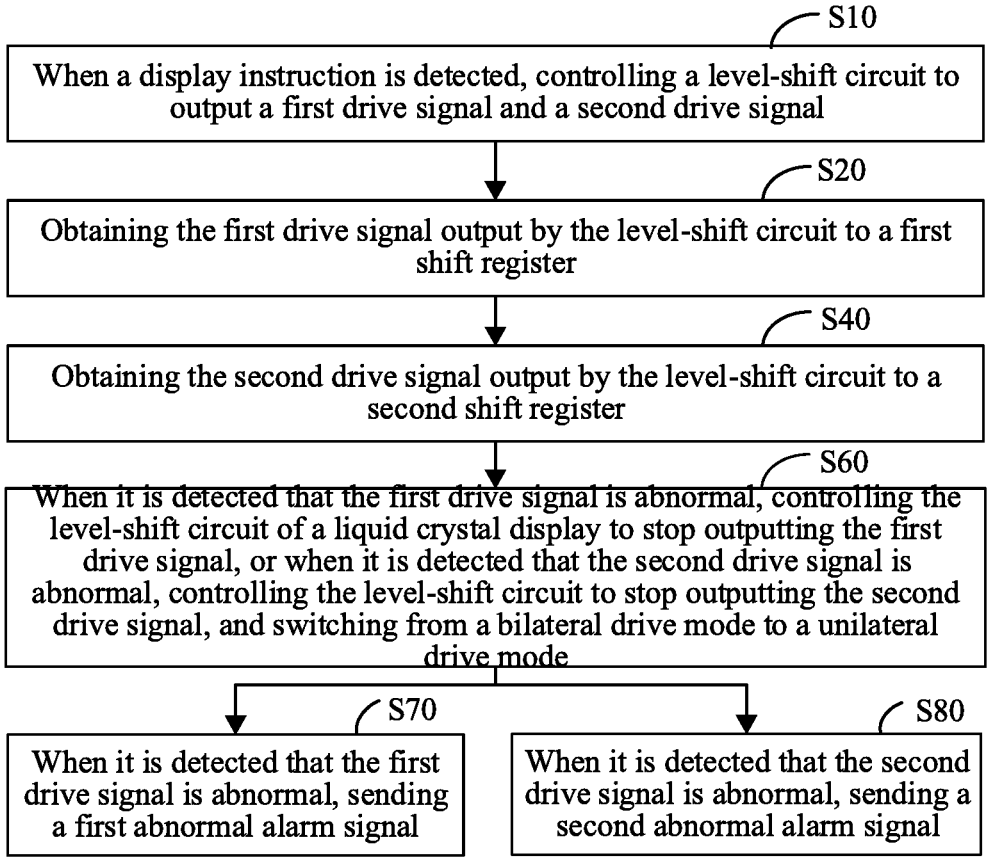
FIG. 7 is a flowchart of a control method according to one or more embodiments.
Figure 8:
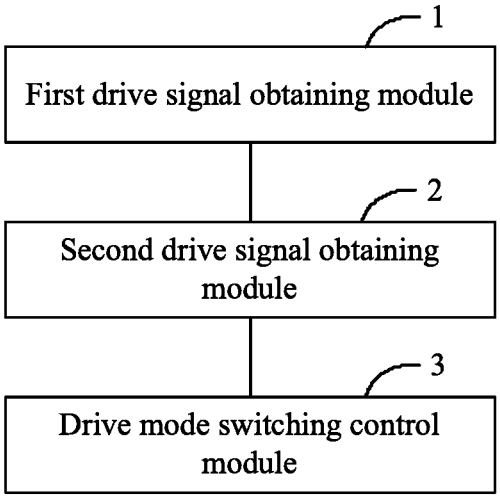
FIG. 8 is a block diagram of a control device according to one or more embodiments.

In one of the embodiments, as shown in FIG. 7, the control method further includes the following step.

In S70, when it is detected that the first drive signal is abnormal, a first abnormal alarm signal is sent.

The first abnormal alarm signal is a signal used for representing that the first shift register is damaged. When it is detected that the first drive signal is abnormal, it indicates that the first shift register is damaged. In this case, a user or a manufacturer customer service needs to be reminded to perform subsequent maintenance on a corresponding fault point, and the first abnormal alarm signal can be sent to perform fault reminding. The first abnormal alarm signal can be sent to a user terminal. The user terminal can be a mobile phone, a tablet computer, a personal computer (PC), or the like. Alternatively, the first abnormal alarm signal can be sent to a manufacturer service cloud platform, and the manufacturer service cloud platform sends maintenance requirement information to an engineer by using a notification in a form of a short messaging service message, WeChat, or the like to instruct the engineer to perform on-site maintenance.

In one embodiment, as shown in FIG. 7, the control method further includes the following step.

In S80, when it is detected that the second drive signal is abnormal, a second abnormal alarm signal is sent.

The second abnormal alarm signal is a signal used for representing that the second shift register is damaged. When it is detected that the second drive signal is abnormal, it indicates that the second shift register is damaged. In this case, a user or a manufacturer customer service needs to be reminded to perform subsequent maintenance on a corresponding fault point, and the second abnormal alarm signal can be sent to perform fault reminding. The second abnormal alarm signal can be sent to a user terminal. The user terminal can be a mobile phone, a tablet computer, a PC, or the like. Alternatively, the second abnormal alarm signal can be sent to a manufacturer service cloud platform, and the manufacturer service cloud platform sends maintenance requirement information to an engineer by using a notification in a form of a short messaging service message, WeChat, or the like to instruct the engineer to perform on-site maintenance.

In one of the embodiments, as shown in FIG. 7, before the level-shift circuit is controlled to stop outputting the second drive signal, the following step is further included.

In S10, when a display instruction is detected, the level-shift circuit is controlled to output the first drive signal and the second drive signal.

The display instruction is an instruction used for instructing the liquid crystal display to perform a display function. For example, the display instruction can be generated by triggering a power button of a remote control. When the display instruction is detected, to ensure a more uniform liquid crystal display effect, the level-shift circuit is controlled to output the first drive signal and the second drive signal, display drive is performed in the bilateral drive mode, the first shift register drives the liquid crystal panel from the first side, and the second shift register drives the liquid crystal panel from the second side. Driving the liquid crystal panel from the two sides can improve display uniformity of the liquid crystal panel and increase display quality. Therefore, when the display instruction is detected, the bilateral drive mode is first used for working, and the bilateral drive mode is switched to the unilateral drive mode only when it is detected that the first drive signal is abnormal or the second drive signal is abnormal.

It should be understood that although the steps in the flowcharts of FIG. 2 to FIG. 7 are sequentially displayed as indicated by arrows, these steps are not necessarily performed in an order indicated by the arrows. Unless otherwise explicitly stated in this specification, these steps are not performed in a strictly limited order, and the steps can be performed in other orders. In addition, at least some of the steps in FIG. 2 to FIG. 7 can include multiple sub-steps or multiple stages. These sub-steps or stages are not necessarily performed at a same moment, but can be performed at different moments. These sub-steps or stages are not necessarily performed sequentially, but can be performed by turns or alternately with other steps or at least some sub-steps or stages of other steps.

A control device includes:

a first drive signal obtaining module 1, used to obtain a first drive signal output by a level-shift circuit to a first shift register;

a second drive signal obtaining module 2, used to obtain a second drive signal output by the level-shift circuit to a second shift register; and a drive mode switching control module 3, used to: when it is detected that the first drive signal is abnormal, control the level-shift circuit of a liquid crystal display to stop outputting the first drive signal, or when it is detected that the second drive signal is abnormal, control the level-shift circuit to stop outputting the second drive signal, and switch from a bilateral drive mode to a unilateral drive mode.

Explanations of terms such as the first drive signal and the first shift register are the same as those in the foregoing embodiments. Details are not described herein again. The first drive signal obtaining module 1 obtains the first drive signal output by the level-shift circuit to the first shift register. The second drive signal obtaining module 2 obtains the second drive signal output by the level-shift circuit to the second shift register. The drive mode switching control module 3 controls, when it is detected that the first drive signal is abnormal, the level-shift circuit of the liquid crystal display to stop outputting the first drive signal, or the drive mode switching control module 3 controls, when it is detected that the second drive signal is abnormal, the level-shift circuit to stop outputting the second drive signal, thereby implementing switching from the bilateral drive mode to the unilateral drive mode. This ensures that when a shift register on a single side is faulty, normal display of the liquid crystal panel can be ensured by cutting off a drive signal output to the shift register on the faulty side.

For specific definition of the control device, refer to the foregoing definition of the aforementioned control method. Details are not described herein again. All or some of the modules in the foregoing control device can be implemented by using software, hardware, or a combination thereof. The foregoing modules can be embedded in or independent of a processor of a computer device in a form of hardware, or can be stored in a memory in the computer device in a form of software, so as to be invoked by the processor to perform operations corresponding to the foregoing modules.

A controller includes a processor and a memory storing a computer-readable instruction, which, when performed by the processor, causes the processor to execute a program to implement the steps of switching and controlling a drive mode of the foregoing liquid crystal panel.

The controller can be a microcontroller, a computer, an embedded controller, or the like. The memory stores a program of the process of switching and controlling the drive mode of the liquid crystal panel. When the processor works, the processor obtains the program stored in the memory, and when running the program, the processor obtains a first drive signal output by a level-shift circuit to a first shift register and a second drive signal output by the level-shift circuit to a second shift register, and then detects whether the first drive signal and the second drive signal are abnormal. When it is detected that the first drive signal is abnormal, it indicates that the first shift register is damaged. To ensure normal working of the liquid crystal panel, the level-shift circuit is controlled to stop outputting the first drive signal, and instead, the second shift register drives the liquid crystal panel on a single side. Similarly, when it is detected that the second drive signal is abnormal, the level-shift circuit is controlled to stop outputting the second drive signal, and the bilateral drive mode is switched to the first shift register to drive the liquid crystal panel on a single side. The controller can include a timing controller. The timing controller is used to: obtain the first drive signal and the second drive signal, and detect the first drive signal and the second drive signal. According to whether the first drive signal and the second drive signal are abnormal, the timing controller disables an output of the level-shift circuit to an abnormal side, and switches to a unilateral drive mode.

Figure 9:
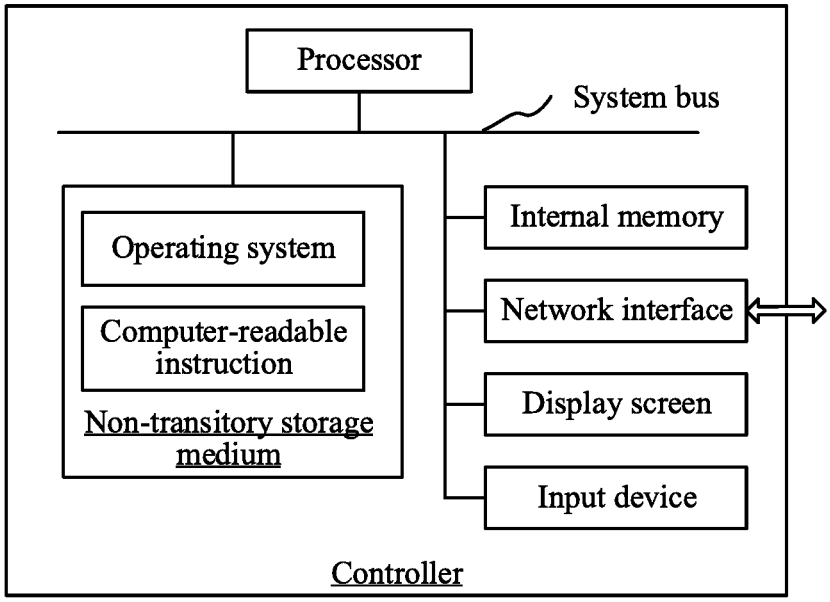
FIG. 9 is a block diagram of a controller according to one or more embodiments.

In an embodiment, the controller can be a terminal, and an internal structures of the controller can be shown in FIG. 9. The controller includes a processor, a memory, a network interface, a display, and an input device that are connected by a system bus. The processor of the controller is used to provide computing and control capabilities. The memory of the controller includes a non-transitory storage medium and an internal memory. The non-transitory storage medium stores an operating system and a computer-readable instruction. The internal memory provides an environment for running of the operating system and the computer-readable instruction in the non-transitory storage medium. The network interface of the controller is used to communicate with an external terminal through network connection. The computer-readable instruction is executed by the processor to implement a control method. The input device of the controller can be a touch layer covered on a display screen, or can be a button, a trackball, or a touchpad arranged on a housing of the controller, or can be an external keyboard, touchpad, mouse, or the like.

A person skilled in the art can understand that, in the structure shown in FIG. 9, only a block diagram of a partial structure related to a solution in this application is shown, and does not constitute a limitation on the controller to which the solution in this application is applied. The controller can include more components or fewer components than those shown in the figure, or some components can be combined, or a different component deployment can be used.

Figure 10:
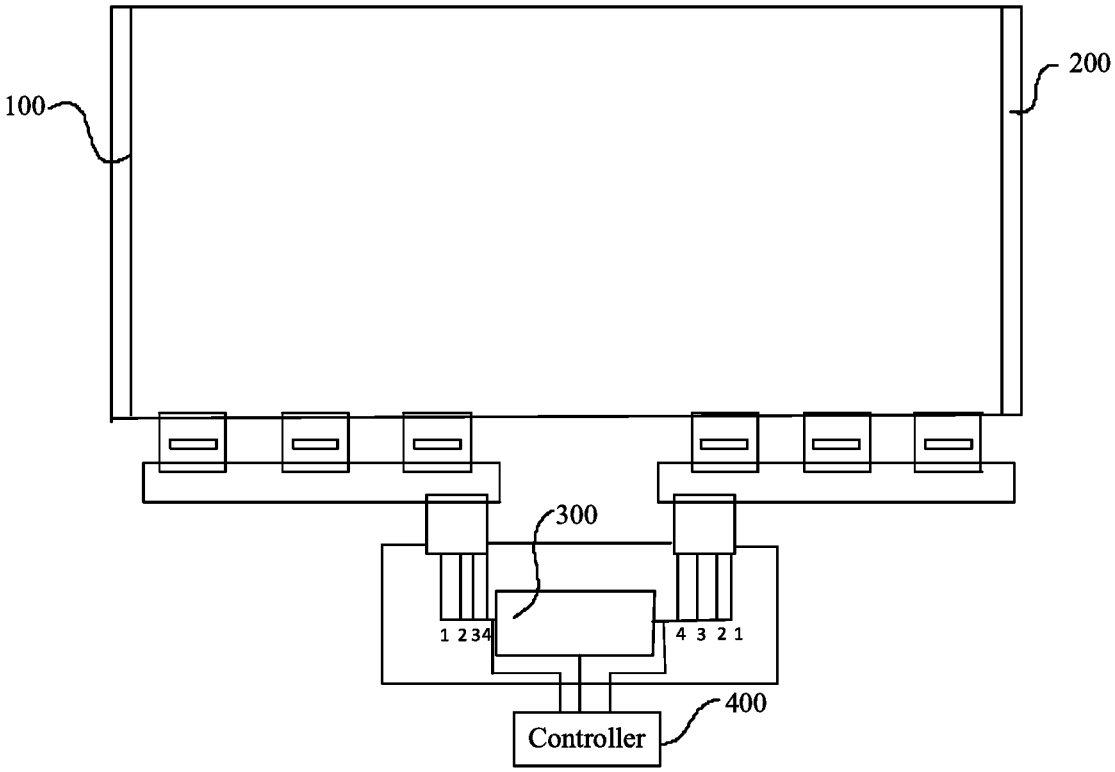
FIG. 10 is a schematic diagram of a liquid crystal panel drive module according to one or more embodiments.

As shown in FIG. 10, a liquid crystal panel drive device includes a first shift register 100, a second shift register 200, a level-shift circuit 300, and the foregoing controller 400. The first shift register 100 and the second shift register 200 are the same as those in the foregoing embodiments. Details are not described herein again. The controller 400 obtains a first drive signal output by the level-shift circuit 300 to the first shift register 100 and a second drive signal output by the level-shift circuit 300 to the second shift register 200, and when it is detected that the first drive signal is abnormal, controls the level-shift circuit 300 to stop outputting the first drive signal. Alternatively, when it is detected that the second drive is abnormal, the controller 400 controls the level-shift circuit 300 to stop outputting the second drive signal. The liquid crystal panel drive device provided in this embodiment of this application detects whether one of the drive signals is abnormal to determine whether a corresponding shift register is abnormal, so as to control, when a shift register on a single side is abnormal, the level-shift circuit 300 to stop outputting a drive signal to the abnormal shift register, and instead, a normally working shift register performs liquid crystal display drive, thereby ensuring normal display of a liquid crystal panel.

Figure 11:
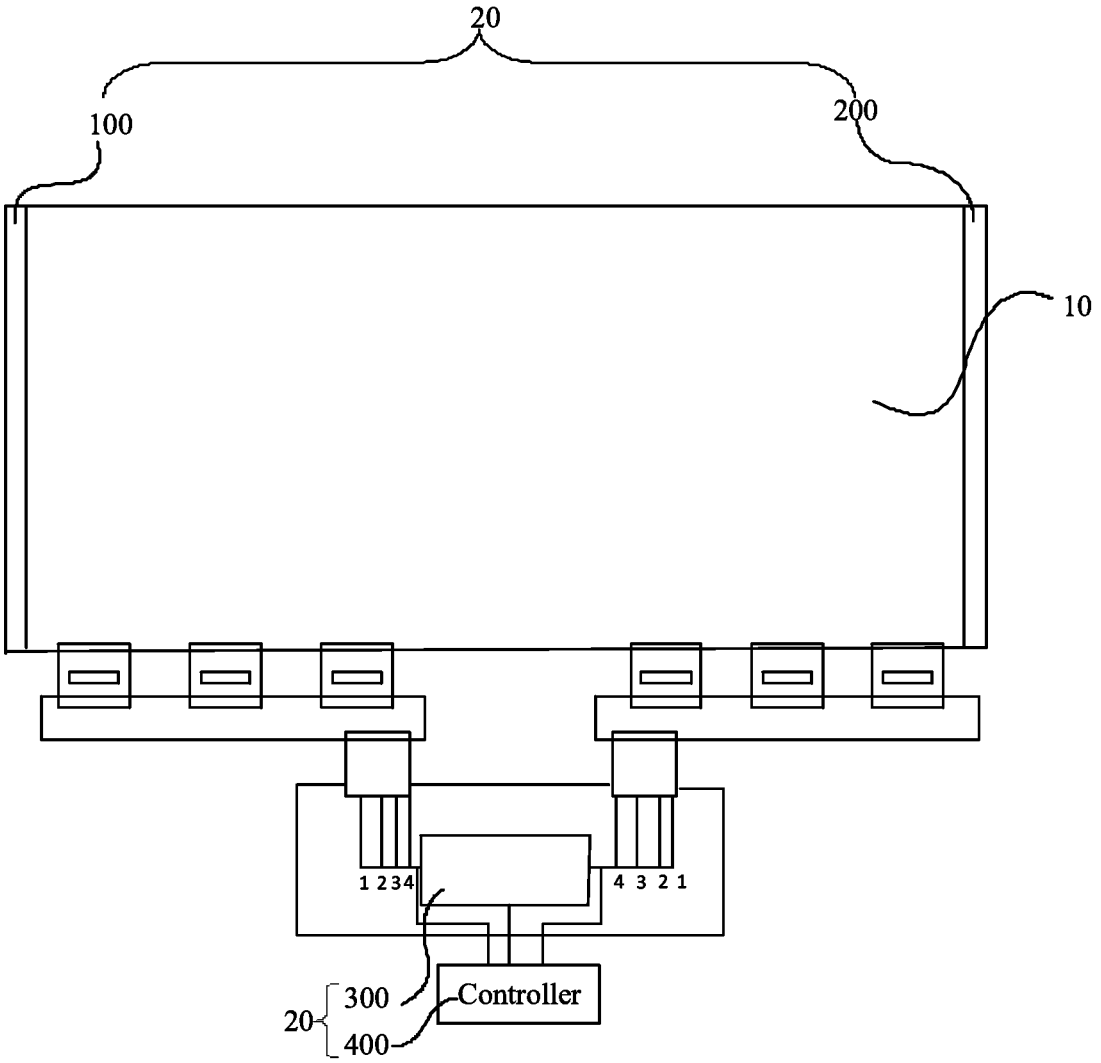
FIG. 11 is a schematic diagram of a display according to one or more embodiments.

As shown in FIG. 11, a display includes a liquid crystal panel 10 and the foregoing liquid crystal panel drive device 20. Explanations of terms such as the first shift register 100 and the second shift register 200 are the same as those in the foregoing embodiments. Details are not described herein again. The liquid crystal panel drive device 20 in the display provided in this embodiment of this application can switch the drive mode of the liquid crystal panel 10 according to whether the first drive signal and the second drive signal are abnormal. When the first shift register 100 and the second shift register 200 can both work normally, a bilateral drive module is used. When the first shift register 100 or the second shift register 200 is faulty, a drive signal output to the faulty shift register is cut off, thereby switching to the unilateral drive mode.

One or more non-transitory computer readable storage media store computer-readable instructions, which, when executed by one or more processors, cause the one or more processors to perform the following steps.

In S20, a first drive signal output by a level-shift circuit to a first shift register is obtained.

In S40, a second drive signal output by the level-shift circuit to a second shift register is obtained.

In S60, when it is detected that the first drive signal is abnormal, the level-shift circuit of a liquid crystal display is controlled to stop outputting the first drive signal, or when it is detected that the second drive signal is abnormal, the level-shift circuit is controlled to stop outputting the second drive signal, and a bilateral drive mode is switched to a unilateral drive mode.

A person of ordinary skill in the art can understand that all or some of the procedures of the methods in the foregoing embodiments can be implemented by a computer-readable instruction instructing relevant hardware. The computer-readable instruction can be stored in a non-transitory computer-readable storage medium. When the computer-readable instruction is executed, the procedures of the foregoing method embodiments can be performed. Any reference to a memory, storage, database, or other mediums used in the embodiments provided in this application can include a non-transitory and/or transitory memory. A non-transitory memory can include a read-only memory (ROM), a programmable ROM (PROM), an electrically programmable ROM (EPROM), an electrically erasable programmable ROM (EEPROM), a flash memory, or the like. The transitory memory can include a random access memory (RAM) or an external high-speed cache. By way of illustration and not limitation, the RAM is available in various forms, such as a static RAM (SRAM), a dynamic RAM (DRAM), a synchronous DRAM (SDRAM), a double data rate SDRAM (DDRSDRAM), an enhanced SDRAM (ESDRAM), a synchronization link (Synchlink) DRAM (SLDRAM), a rambus (Rambus) direct RAM (RDRAM), a direct rambus dynamic RAM (DRDRAM), and a rambus dynamic RAM (RDRAM).

Various technical features in the foregoing embodiments can be combined randomly. For ease of description, possible combinations of various technical features in the foregoing embodiments are not all described. However, the combinations of the technical features should be considered as falling within the scope recorded in this specification provided that the combinations of the technical features are compatible with each other.

The foregoing embodiments show only several implementations of this application and are described in detail, but they should not be construed as a limitation on the patent scope of this application. It should be noted that various changes and improvements can further be made by a person of ordinary skill in the art without departing from the idea of this application, and these changes and improvements all fall within the protection scope of this application. Therefore, the protection scope of the patent of this application shall be subject to the appended claims.

What is claimed is:

1. A control method, comprising:

obtaining a first drive signal output by a level-shift circuit to a first shift register;

obtaining a second drive signal output by the level-shift circuit to a second shift register; and when it is detected that the first drive signal is abnormal, controlling the level-shift circuit of a liquid crystal display to stop outputting the first drive signal, or when it is detected that the second drive signal is abnormal, controlling the level-shift circuit to stop outputting the second drive signal, and switching from a bilateral drive mode to a unilateral drive mode, wherein when in the bilateral drive mode, the level-shift circuit outputs the first and second drive signals respectively from two sides of the liquid crystal panel, and performs display drive from the two sides, and wherein when in the unilateral drive mode, the level-shift circuit outputs the first or second drive signals from a first side of the liquid crystal panel and performs display drive from the first side of the liquid crystal panel.

2. The control method according to claim 1, wherein the first drive signal comprises a plurality of first clock signals, and the step of detecting whether the first drive signal is abnormal comprises:

obtaining currents of the first clock signals; and when it is detected that the current of at least one of the first clock signals is abnormal, determining that the first drive signal is abnormal.

3. The control method according to claim 2, wherein the second drive signal comprises a plurality of second clock signals, and after the step of switching from a bilateral drive mode to a unilateral drive mode, the method further comprises:

when it is detected that the first drive signal is abnormal, controlling a plurality of second clock signals output by the level-shift circuit, wherein charging start time points of the second clock signals are sequentially delayed, and charging time periods of two neighboring second clock signals have an intersection set.

4. The control method according to claim 1, wherein the second drive signal comprises a plurality of second clock signals, and the step of detecting whether the second drive signal is abnormal comprises:

obtaining currents of the second clock signals; and when it is detected that the current of at least one of the second clock signals is abnormal, determining that the second drive signal is abnormal.

5. The control method according to claim 4, wherein the first drive signal comprises a plurality of first clock signals, and after the step of switching from a bilateral drive mode to a unilateral drive mode, the method further comprises:

when it is detected that the second drive signal is abnormal, controlling a plurality of first clock signals output by the level-shift circuit, wherein charging start time points of the first clock signals are sequentially delayed, and charging time periods of two neighboring first clock signals have an intersection set.

6. The control method according to claim 1, further comprising:

when it is detected that the first drive signal is abnormal, sending a first abnormal alarm signal.

7. The control method according to claim 1, further comprising:

when it is detected that the second drive signal is abnormal, sending a second abnormal alarm signal.

8. The control method according to claim 1, wherein before the step of obtaining a first drive signal output by a level-shift circuit to a first shift register, the method further comprises:

when a display instruction is detected, controlling the level-shift circuit to output the first drive signal and the second drive signal.

9. A controller, comprising:

one or more processors; and a memory storing a computer-readable instruction, which, when executed by the one or more processors, causes the one or more processors to perform the following steps:

obtaining a first drive signal output by a level-shift circuit to a first shift register;

obtaining a second drive signal output by the level-shift circuit to a second shift register; and when it is detected that the first drive signal is abnormal, controlling the level-shift circuit of the liquid crystal display to stop outputting the first drive signal, or when it is detected that the second drive signal is abnormal, controlling the level-shift circuit to stop outputting the second drive signal, and switching from a bilateral drive mode to a unilateral drive mode, wherein when in the bilateral drive mode, the level-shift circuit outputs the first and second drive signals respectively from two sides of the liquid crystal panel, and performs display drive from the two sides, and wherein when in the unilateral drive mode, the level-shift circuit outputs the first or second drive signals from a first side of the liquid crystal panel and performs display drive from the first side of the liquid crystal panel.

10. The controller according to claim 9, wherein the processor further performs the following steps when executing the computer-readable instruction:

obtaining currents of first clock signals of the first drive signal; and when it is detected that the current of at least one of the first clock signals is abnormal, determining that the first drive signal is abnormal.

11. The controller according to claim 10, wherein the processor further performs the following steps when executing the computer-readable instruction:

when it is detected that the first drive signal is abnormal, controlling a plurality of second clock signals output by the level-shift circuit, wherein charging start time points of the second clock signals are sequentially delayed, and charging time periods of two neighboring second clock signals have an intersection set.

12. The controller according to claim 9, wherein the processor further performs the following steps when executing the computer-readable instruction:

obtaining currents of second clock signals of the second drive signal; and when it is detected that the current of at least one of the second clock signals is abnormal, determining that the second drive signal is abnormal.

13. The controller according to claim 12, wherein the processor further performs the following steps when executing the computer-readable instruction:

when it is detected that the second drive signal is abnormal, controlling a plurality of first clock signals output by the level-shift circuit, wherein charging start time points of the first clock signals are sequentially delayed, and charging time periods of two neighboring first clock signals have an intersection set.

14. The controller according to claim 9, wherein the processor further performs the following step when executing the computer-readable instruction:

when it is detected that the first drive signal is abnormal, sending a first abnormal alarm signal.

15. The controller according to claim 9, wherein the processor further performs the following steps when executing the computer-readable instruction:

when it is detected that the second drive signal is abnormal, sending a second abnormal alarm signal.

16. The controller according to claim 9, wherein the processor further performs the following step when executing the computer-readable instruction:

when a display instruction is detected, controlling the level-shift circuit to output the first drive signal and the second drive signal.

17. A liquid crystal panel drive device, comprising a first shift register, a second shift register, a level-shift circuit, and the controller according to claim 9.

18. The liquid crystal panel drive device according to claim 17, wherein the processor in the controller further performs the following steps when executing the computer-readable instruction:

obtaining currents of first clock signals of the first drive signal; and when it is detected that the current of at least one of the first clock signals is abnormal, determining that the first drive signal is abnormal.

19. The liquid crystal panel drive device according to claim 18, wherein the processor in the controller further performs the following step when executing the computer-readable instruction:

when it is detected that the first drive signal is abnormal, controlling a plurality of second clock signals output by the level-shift circuit, wherein charging start time points of the second clock signals are sequentially delayed, and charging time periods of two neighboring second clock signals have an intersection set.

20. The liquid crystal panel drive device according to claim 17, wherein the processor in the controller further performs the following steps when executing the computer-readable instruction:

obtaining currents of second clock signals of the second drive signal; and when it is detected that the current of at least one of the second clock signals is abnormal, determining that the second drive signal is abnormal.

* * * * *